US005156400A

United States Patent [19]

Nemeth

[11] Patent Number: 5,156,400

[45] Date of Patent: Oct. 20, 1992

[54] GOLF SWING PRACTICE DEVICE

[76] Inventor: Laszlo N. Nemeth, 18358 NE. 23rd Ct., North Miami Beach, Fla. 33160

[21] Appl. No.: 766,329

[22] Filed: Sep. 27, 1991

[51] Int. Cl.[5] ..... A63B 69/36

[52] U.S. Cl. ..... 273/185 C; 273/200 R

[58] Field of Search ..... 273/134 R, 184 B, 185 R, 273/185 C, 185 D, 200 R, 200 A

[56] References Cited

U.S. PATENT DOCUMENTS

| | | | |
|---|---|---|---|
| 1,857,267 | 5/1932 | Tyler et al. | 273/185 C |
| 2,201,697 | 5/1940 | Martin et al. | 273/185 C |
| 3,115,346 | 12/1963 | Pohle | 273/185 C |
| 3,430,493 | 3/1969 | Wall | 273/185 C |
| 4,118,032 | 10/1978 | Koblick | 273/185 C |
| 4,119,318 | 10/1978 | de Kremer et al. | 273/200 R X |
| 4,139,197 | 2/1979 | Windall | 273/185 C |
| 5,035,432 | 7/1991 | Lew | 273/185 C X |

FOREIGN PATENT DOCUMENTS

| | | | |
|---|---|---|---|
| 179478 | 5/1922 | United Kingdom | 273/185 C |
| 2196860 | 5/1988 | United Kingdom | 273/185 C |

OTHER PUBLICATIONS

"Do-Ma Home Golf Course", *Golf World*, vol. 13, No. 12, Aug. 21, 1959, p. 20.

*Primary Examiner*—William H. Grieb
*Assistant Examiner*—William E. Stoll
*Attorney, Agent, or Firm*—Antonelli, Terry, Stout & Kraus

[57] ABSTRACT

A golf practice device for determining a flight path and a travel distance of a driven golf ball with the device including a flexible base having a housing mounted thereon. A driving power mechanism is accommodated in the housing, with the driving power mechanism being adapted to provide an indication of, for example, the power of the drive, a travel distance of the golf ball, or any other appropriate score. An accuracy measuring device is also accommodated in the housing for enabling determining of a flight path of the golf ball. The travel distance and flight path of the driven golf ball are provided on scales on the housing cooperable with pointers, one of which is responsive to the flight path of the ball and the other of which is responsive to the driving power mechanism.

19 Claims, 7 Drawing Sheets

GOLF SWING PRACTICE DEVICE

FIELD OF THE INVENTION

The present invention relates to a golfing device and, more particularly, to a portable golf practice device which enables a user to determine power and accuracy of a driven golf ball.

BACKGROUND OF THE INVENTION

A golf practice device has been proposed in, for example, U.S. Pat. No. 4,118,032 which enables a golf enthusiast to, for example, practice driving without the necessity of going to private or public golf courses or driving ranges.

SUMMARY OF THE INVENTION

The aim underlying the present invention essentially resides in providing a golf practice device of the aforementioned type which includes an improved system for measuring accuracy and driving power imparted to a golf ball as well as an improved system for enabling a driving of the golf ball from the golf practice device.

In accordance with advantageous features of the present invention, a golf practice device for determining a flight path and a travel distance of a driven golf ball is provided with a device including a flexible base for supporting the device and a housing mounted on the flexible base. Means are mounted in the housing for enabling a measurement of the travel distance of the golf ball including a longitudinally extending guide member, a further member mounted on the guide member and displaceable in response to the driving of the golf ball, an elastic means connected to the guide member and to the further member for providing a force reflecting the travel distance of the golf ball, and a pointer mounted on the housing displaceable by the further member in response to a displacement of the further member along the guide member, with a scale being provided on the housing and being cooperable with the pointer for providing an indication of the travel distance of the golf ball. As can readily be appreciated, it is also possible for the scale to reflect, for example, the power with which the golf ball is struck or any other indicia of interest to the user of the practice device.

In accordance with further features of the present invention, a means are provided for enabling a determination of a path of the driven golf ball including a further pointer which is pivotably mounted on the guide member and is pivotable in response to deviations in the flight path of the golf ball and a further scale means mounted on the housing and cooperable with the further pointer for providing an indication of the flight path of the golf ball to the user.

The golf ball is connected to the further member by a cord of, for example, nylon, with the further pointer being fashioned as a hollow tubular member through which the cord extends.

To enable an accurate response of the pointer providing an indication of the flight path, the pointer is mounted on a rotatable base member, with the rotatable base member being adjustably mounted on the guide member.

A pair of support members are provided at opposite ends of the guide member, with the support members supporting the guide member in the housing. To prevent a damage to the further member or the support members, a cushioning means may be provided on one or more of the support members for cushioning an impact of the further member against the support members. Advantageously, the scale means for providing an indication of the travel distance is arranged along a longitudinally extending slot provided in the housing, with the pointer cooperable with the scale being displaceably mounted along an edge of the slot.

A means is provided on the flexible base member for enabling a teeing-up of the golf ball, with such means advantageously including a flexible support member of, for example, rubber mounted in the flexible base member and a tubular member mounted on the flexible support member for supporting the golf ball thereon.

To facilitate as well as to ensure a secure fastening of the golf ball to the cord, the golf ball includes an opening extending therethrough for accommodating a means for securing an end of the cord to the golf ball.

Additionally, to prevent a loss of the tubular member mounted on the flexible support of the teeing-up means, the tubular member is tethered to the flexible base member so as to prevent the tubular member from being displaced beyond a predetermined distance upon a driving of the golf ball.

To facilitate a storage of the device of the present invention, means, fashioned, for example, as buttons or pins, are provided on the housing so as to enable the cord to be directly stored on the housing when the device is not in use.

The flexible base member is advantageously provided with an artificial turf-type surface so as to simulate actual golfing conditions.

After setting up the device on a selected surface, the nylon cord is orderly arranged on the surface with one end of the nylon cord being connected to the ball and the other being connected to the power drive mechanism and, in this manner, the golf ball will not go any further than a desired distance. Generally, the distance is normally 40 to 50 yards which is more than enough to fully appreciate and enjoy the golf practice device.

After the ball is teed-up, upon hitting the ball, the ball will be driven in the direction determined by the stroke of the player thereby pulling the nylon cord, with the other end passing through the pointer so as to mark any deviation in the accuracy scale.

As the cord passes through the pointer, the nylon cord is adjusted against a sliding fit of the further member which advances in a forward direction at the same speed as the ball. The sliding fit of the further member is connected to the guide member by elastic means such as a rubber band which is strong, with the band having the function of slowing down the ball. The ball will then fall and the marking arrow or pointer will provide an indication of the distance or power on the scale provided on the housing or, for example, simply register a score, which score will obviously be higher in accordance with the power put into the stroke.

If, for example, the scale is listed in power units, the scores from the power scale could be deducted on the basis of the scores registered in the accuracy scale or gauge of the present invention thereby providing, for example, a penalty system for strokes which deviate to the left or right thereby providing for interesting game possibilities for the device of the present invention.

Retrieval of the golf ball with the device of the present invention is relatively simple inasmuch as the golf ball can be retrieved by simply drawing in the cord and, for example, such retrieval, on the average, will take no more than 30 seconds.

After the score is marked and the power, travel distance and accuracy scales are noted, the pointers are then returned to a zero point in order to register for the next stroke.

The power scale may reflect total yardage and, for example, with a top figure of 220, the player must use the same power as in an actual golf game which would advance the golf ball to 220 yards. As readily apparent, the top figure of the power scale can reflect any travel distance of the golf ball or other criteria meaningful to the user of the device.

The above and other objects, features and advantages of the present invention will become more apparent from the following description when taken in connection with the accompanying drawings which show, for the purposes of illustration only, one embodiment in accordance with the present invention.

Figure 1:
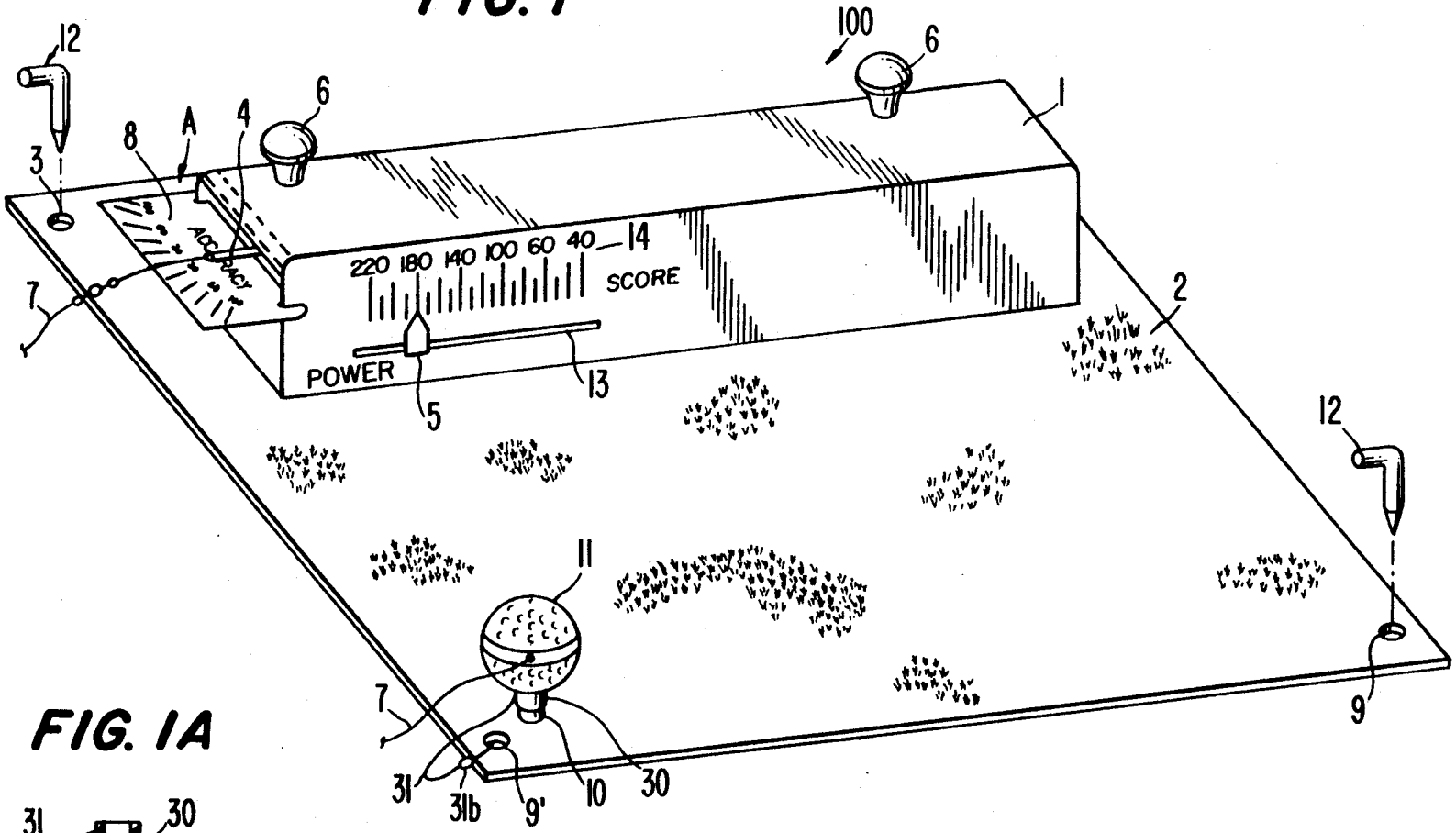
FIG. 1 is a perspective view of a golf practice device constructed in accordance with the present invention.
Figure 7D:
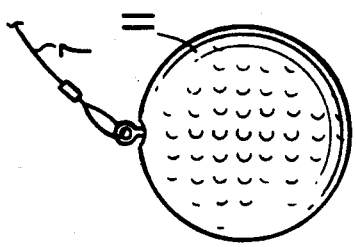
Figure 7C:
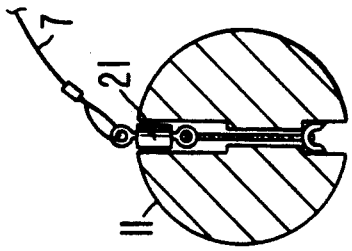
Figure 7B:
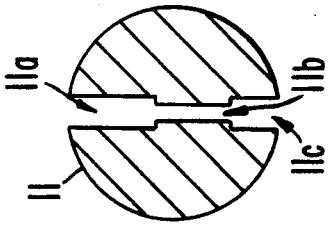
Figure 7A:
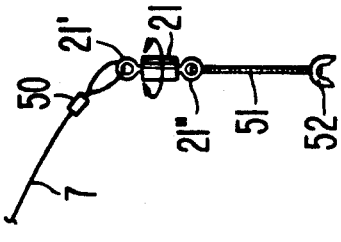
Figure 9:
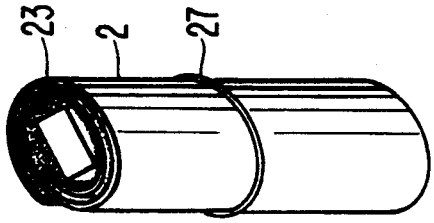
Figure 8:
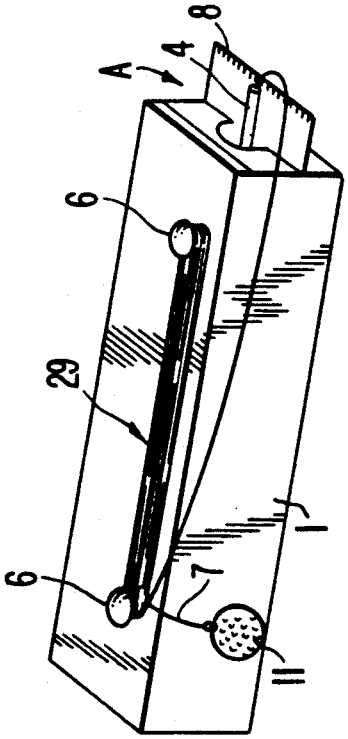

FIG. **6*b* is a schematic view of the golf device of FIG. 1** following a drive of the golf ball;

FIG. 7A is a plan view of a connection for connecting the golf ball to a tether;

FIG. 7B is a cross-sectional view of the golf ball;

FIG. 7C is a cross-sectional view of the golf ball of FIG. 7B fastened to an end of the tether;

FIG. 7D is a plan view of the assembly of the end of the tether and the golf ball;

FIG. 8 is a schematic perspective view of the driving power measuring and accuracy mechanism of the golf device having the tether secured thereto in a stored position; and FIG. 9 is a schematic perspective view of the entire golf practice device of the present invention packed for storing.

DETAILED DESCRIPTION

Referring now to the drawings wherein like reference numerals are used throughout the various views to designate like parts and, more particularly, to FIG. 1, according to this Figure, a golf practice device generally designated by the reference numeral 100, constructed in accordance with the present invention, includes a housing 1, preferably formed of a durable plastic material, mounted on a base member 2 formed of a plastic material preferably simulating an artificial grass surface, with a plurality of holes 3, 3', 9, 9' for accommodating fastening elements such as, for example, L-shaped spike members 12 adapted to be driven into a base surface such as the ground in order to secure the base 2 in position. The base member 2 is preferably rectangular, with the housing 1 extending parallel to the longest side thereof.

Figure 1A:
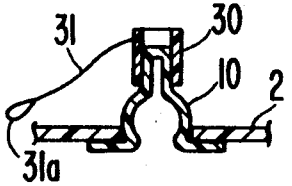
FIG. 1A is a partial cross-sectional view of a tee assembly for the golf device of FIG. 1.

As shown most clearly in FIG. 1A, a tee member 10 is mounted to the base member 2 and is adapted to accommodate a placement element 30 upon which a golf ball 11 is placed prior to driving. A tether 31 is secured to the placement element 30 and, for example, to one of the spike members 21 accommodated in the hole 9' in order to facilitate a retrieval of the placement element 30 following a driving of the golf ball 11. For this purpose, the tether 31 may be provided with a loop portion **31*a* to which the spike member 21 is inserted or, as shown in FIG. 1, a clasp, hook member or further loop member 31*b* may be formed integrally with the plastic base member 2**.

Figure 2A:
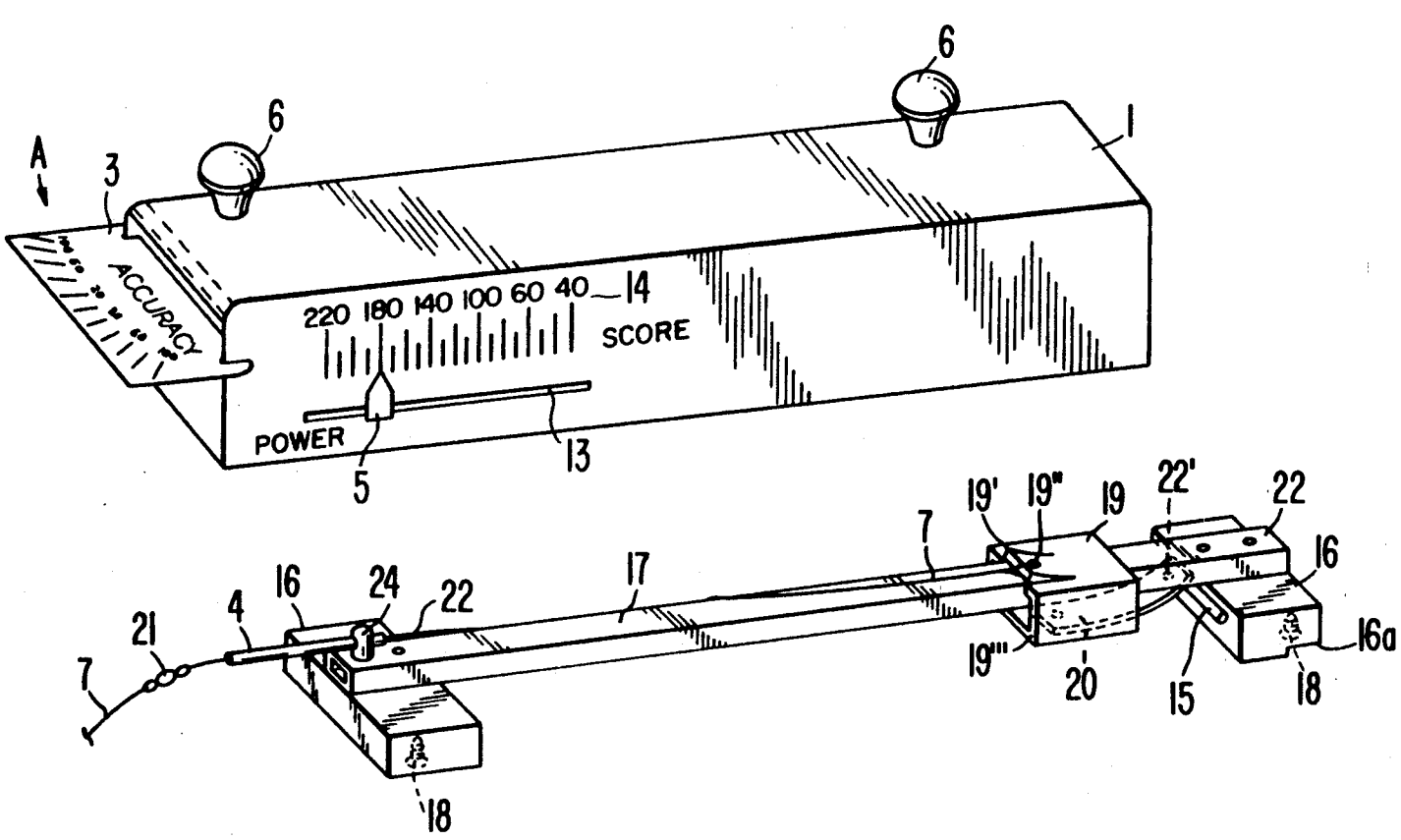
FIG. 2A is an exploded perspective view of a driving power measuring and accuracy mechanism of the golf device of FIG. 1 in an initial position.
Figure 4:
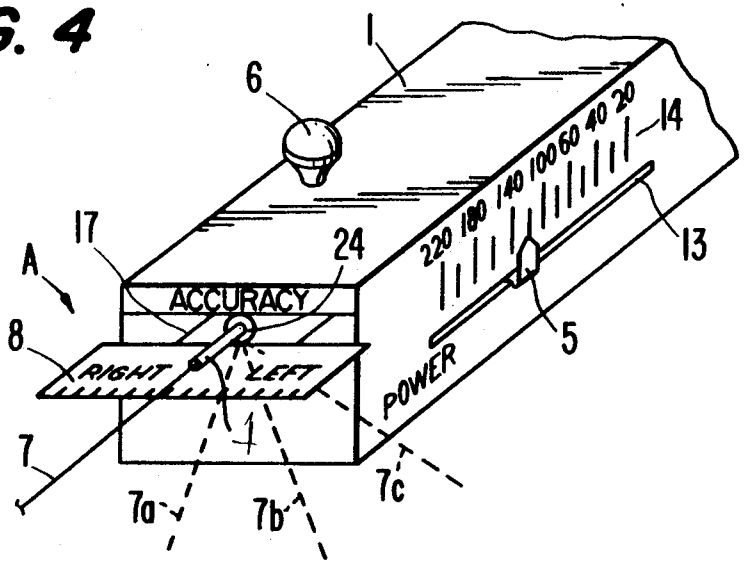
FIG. 4 is a perspective detailed view, on an enlarged scale, of the driving power measuring and accuracy mechanism of the golf device of FIG. 1 depicting an example of a power measurement and several possible flight paths of a golf ball.

The housing 1, as shown most clearly in FIGS. 1, 2A and 4, is provided along one side thereof with a Power/Score indicator scale 14 which, in the illustrated embodiment, is calibrated in yards; however, as can readily be appreciated, any other suitable information relating to the driving of the golf ball 11 could be provided. A pointer 5 is slidably accommodated in a slot 13 provided in the housing 1, with the pointer 5 being slidably displaceable relative to the scale 14 in a manner described more fully hereinbelow. An accuracy scale, generally designated by the reference character A, is provided at a forward end or end of the housing 1 facing the user, with the accuracy scale A including suitable indicia 8 such as, for example, angular deviation to the left or right, with a pointer 4 cooperating with the indicia 8 of the accuracy scale A so as to indicate any deflection in the flight path of the golf ball 1. Button-like projections 6 are provided at the upper surface of the housing 1 so as to enable a nylon cord 7 of, for example, nylon, attached to the golf ball 11 to be stored in a manner generally indicated by the reference numeral 29 in FIG. 8.

As shown most clearly in FIGS. 2A, 2B, 3 and 5, the driving power mechanism includes a central or longitudinally extending guide member 17 secured, at respective opposite ends thereof, by suitable fasteners such as, for example, screws 22 to a support member 16 which, in turn, is secured to the base member 2 by suitable fasteners such as, for example, screws 18. The guide member 17 is fashioned as a hollow channel member of, for example, an aluminum or aluminum alloy, with the support members 16 also being fashioned of a similar material to minimize the weight of the driving power mechanism.

A stroke member 19, also fashioned as a channel member of, for example, an aluminum or aluminum alloy material, is mounted for slidable movement along the guide member 17. The stroke member 19 includes a bent-up portion 19' having opening 19'' therein for enabling a securing of an end of the nylon cord 7 to the stroke member 19. The stroke member 19 also includes a forward end face 19''' which is adapted to be brought into engagement with the pointer 5, slidably mounted in the slot 13 in a manner described more fully hereinbelow.

A strong elastic band 20 is secured at one end to the guide member 17 and at an opposite end to the stroke member 19. The elasticity of the band 20 is selected, in a conventional manner, so as to reflect the desired indicia on the scale 14. As shown in FIG. 2A, in an initial stage prior to driving of the golf ball 11, the stroke member 19 is disposed in proximity to the support member 16 to the right of the Figure and the band 20 is in an unstressed or relaxed condition. Upon a driving of the golf ball 11, the stroke member 19 is displaced along the guide member 17, with the maximum displacement of the stroke member 19 being illustrated in FIG. 2B. A tubular member 15 of, for example, rubber or the like, may be provided on the support member 16 to absorb or cushion a return stroke of the stroke member 19 with respect to the support member 16. If desired, a similar tubular member (not shown) may also be provided at the other support member 16 to absorb the outward displacement of the stroke member 19 to prevent damage to either the stroke member 19 or the other support member 16.

Upon a driving of the golf ball 11, the stroke member 19 is displaced along the guide member 17 through the housing 11, and the end face 19''' is brought into engagement with an end face of the pointer 5 so as to displace the same along a length of the slot 13 to register with the scale 14 and provide a measurement of the power and/or distance of the driven golf ball 11. To facilitate a mounting of the pointer 5 in the slot 13 for a displacement therein, as shown in FIG. 5, the pointer 5 is provided with a substantially U-shaped groove **5*a* engageable over a lower edge of the slot 13, with the pointer 5 also including a bent portion 5*b* adapted to engage the end face 19''' of the stroke member 19**.

Figure 2B:
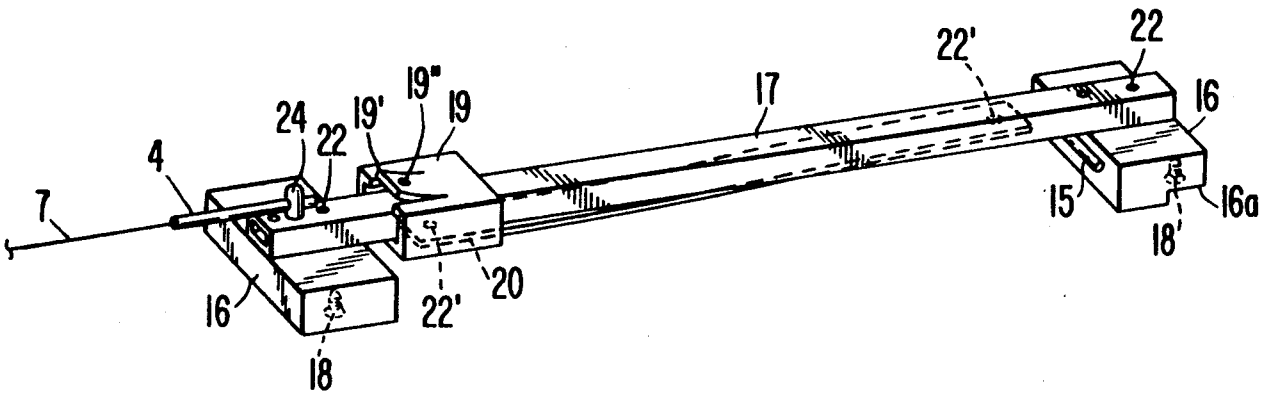
FIG. 2B is a perspective view of the driving power measuring mechanism of the golf device of FIG. 1 in a fully extended position.
Figure 5:
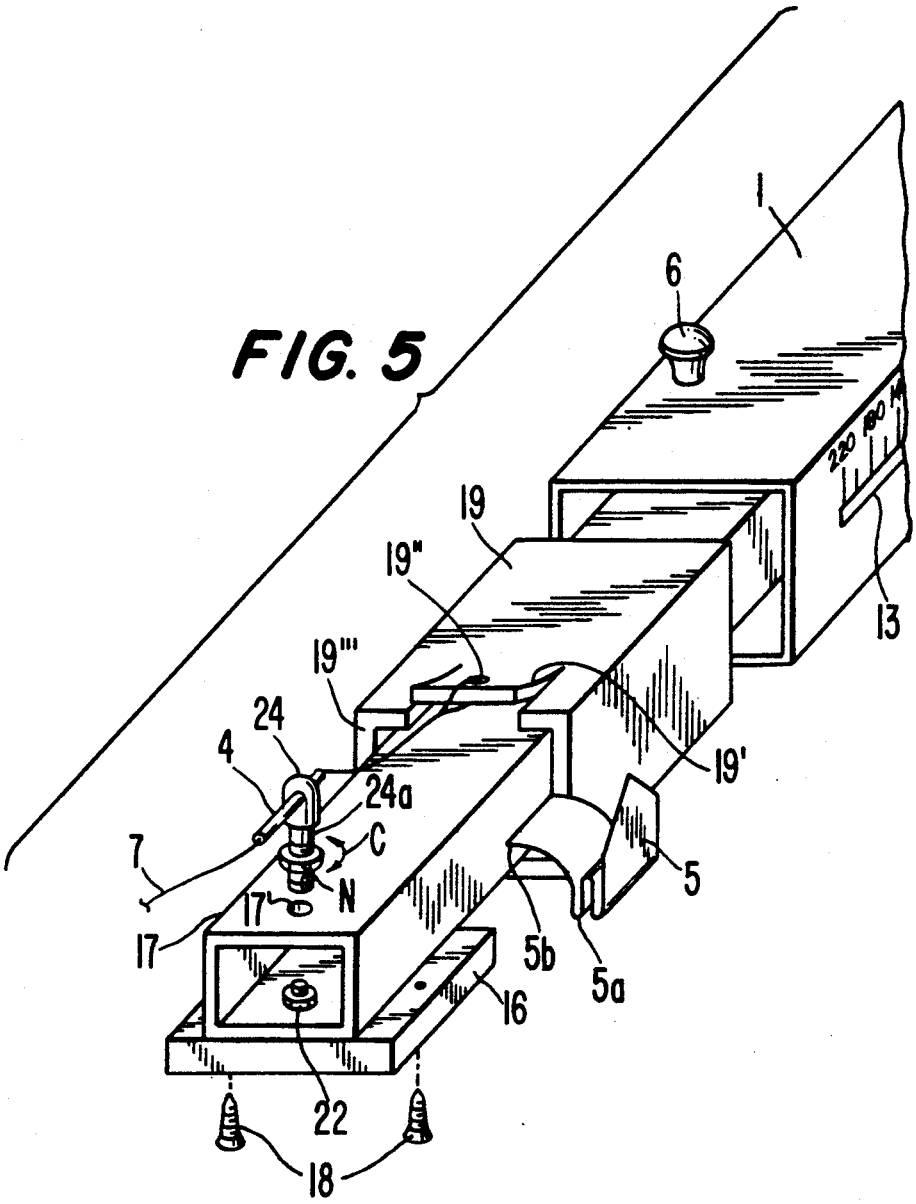
FIG. 5 is an exploded perspective front view of the driving power measuring and accuracy mechanism of the golf device of FIG. 1.

To measure or determine the accuracy of the driven golf ball 11, as shown in FIGS. 2A, 2B and 5, the cord 7 is threaded or led through the pointer 4, formed as a hollow tubular member, mounted in a conventional rotatable base member 24 secured, by a threaded shank **24*a*, in a threaded opening 17' of the guide member 17. A nut N may be provided for enabling an adjustment, by rotation in the direction of the double headed arrow C, of the base member 24 relative to the guide member 17 so as to enable an accurate adjustment of the pointer 4 relative to the indicia 8 on the accuracy gauge A. In lieu of the threaded opening 17', it is also possible to provide another nut (not shown) for threadably engaging a free end of the threaded shank 24*a* at a position below an upper surface of the guide member 17**.

As shown in FIG. 4, upon driving the golf ball 11, the pointer 4, by virtue of the base member 24, is pivotable relative to the accuracy guide A so as to permit a visual determination of the path, for example, path 7, **7*a*, 7*b* or 7*c*, of the driven golf ball 11. Moreover, in order to prevent an entanglement of the nylon cord at the pointer 4 during either a driving or retrieval of the golf ball 11, as shown in FIG. 2A, a conventional universal pivot means, similar, for example, to those found on fishing lures or fishing leaders, is interposed in the nylon cord 7 at a position near the end of the pointer 4**.

As shown in FIGS. 7A–7D, to secure the golf ball 11 to the cord 7, a free end of the cord 7 is passed through a loop 21' of a conventional universal pivot means 21 and either clamped by a clamp 50 or otherwise secured by, for example, tying to the pivot means 21. A suitable securing element such as, for example, a thin threaded rod 51, wire or possibly a further nylon cord is secured to an opposite loop 21'' of the pivot means 21 and is inserted into an opening extending through the golf ball 11. The opening is a stepped opening and provided with an enlarged diameter portion generally designated by the reference numeral **11*a* for receiving the pivot means 21, a smaller diameter portion generally designated by the reference numeral 11*b* for accommodating the rod 51, and a further larger diameter portion generally designated by the reference numeral 11*c* for accommodating fastening means provided on a free end of the rod 51**.

Figure 6B:
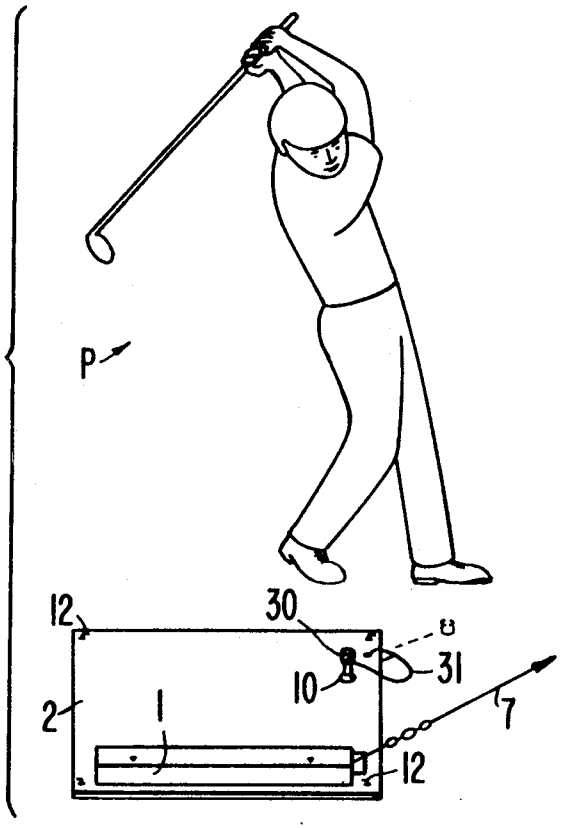
FIG. 6A is a schematic view of the golf device of FIG. 1 with the golf ball in a teed position.
Figure 6A:
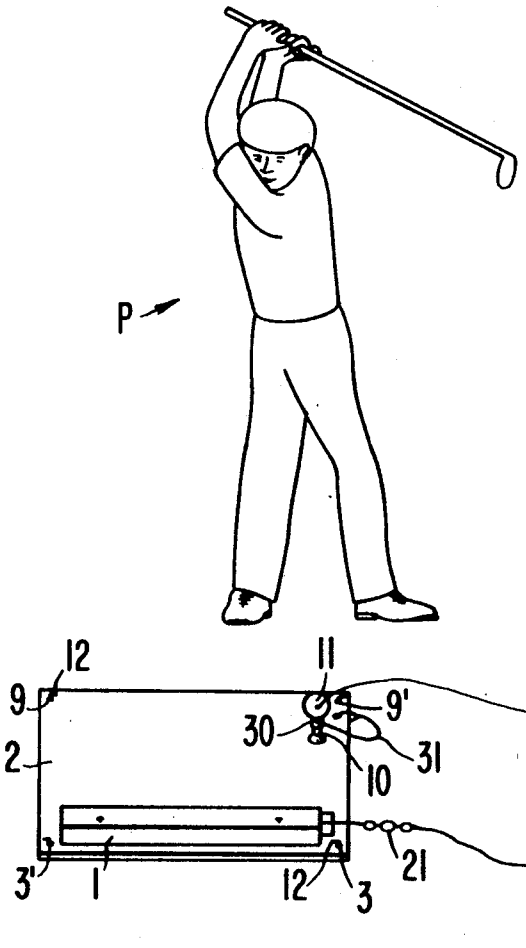

In use, as shown in FIGS. 6A and 6B, the golf practice device is placed on a base surface with the spike members 12 being driven into the base surface so as to hold the base 2 in position, and with the cord 7 being arranged in a somewhat orderly fashion forwardly or in a driving direction of the device. Generally, the cord has a length of between 40 and 50 yards which is more than enough to fully enjoy the golf practice device. Golf ball 11 is placed on a support member 30, preferably formed of a plastic tubular material having a height of about 1", and the player generally designated by the reference character P drives the golf ball 11 resulting in the support member 30 being displaced to the phantom position shown in FIG. 6B and the cord 7 assuming, for example, the path also illustrated in FIG. 6B. The driving of the golf ball 11 results in the stroke member 19 being displaced along the guide 17 thereby stressing the elastic member 20. The displacement of the stroke member 19 results in a displacement of the pointer 5 relative to the scale 14 and the displacement of the cord 7 as a result of the drive results in a displacement of the pointer 4 relative to the accuracy gauge A.

By observing the position of the pointer 4 relative to the accuracy gauge A, the player P is apprised of the path of the golf ball 11 and, subsequent to driving of the golf ball, by observing the position of the pointer 5 relative to the scale 14, the player P can determine the power and/or distance of the driven golf ball 11.

To reuse the device 100, the golf ball 11 is retrieved by way of the cord 7 and the pointer is manually displaced to the end of the slot 13 in preparation for the next drive.

Figure 3:
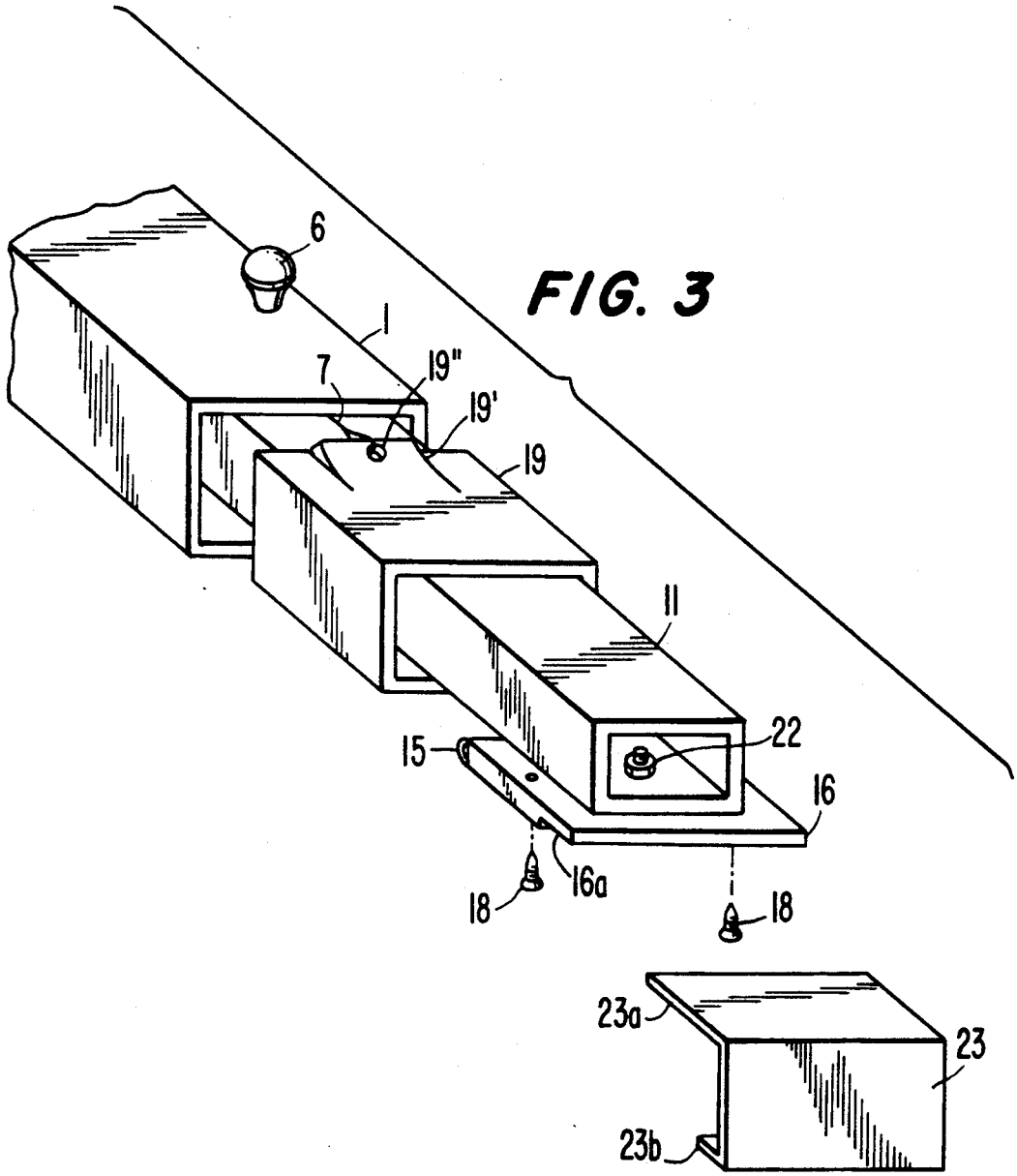
FIG. 3 is an exploded perspective rear view of the driving power measuring and accuracy mechanism of the golf device of FIG. 1.

As shown in FIG. 3, a removable rear cover 23 is provided to permit access to the components of the device 100, with the cover 23 including an upper lip portion **23*a* receivable in the housing 1 and a lower lip portion 23*b* receivable in a stepped portion 16*a* of the rear support member 16**.

When the player P is finished with the device 100, the spiked members 12 are removed from the base surface and the cord 7 is wrapped between the buttons 6 of the housing 1 as shown in FIG. 8, with the base member 2 then being rolled as shown in FIG. 9 and secured by a suitable elastic band 27 or the like so as to permit easy storage of the device 100.

While I have shown and described only one embodiment in accordance with the present invention, it is understood that the same is not limited thereto but is susceptible to numerous changes and modifications as known to one of ordinary skill in the art; I therefore do not wish to be limited to the details shown and described herein, but intend to cover all such modifications as are encompassed by the scope of the appended claims.

I claim:

1. A golf practice device for determining a flight path and a travel distance of a driven golf ball, the device comprising:

a flexible base means for supporting the device;

a housing mounted on said flexible base means;

means mounted in said housing for enabling a measurement of the travel distance of a golf ball including a longitudinally extending guide member, a further member mounted on said guide member and displaceable in response to a driving of a golf ball, an elastic means connected to said guide member and said further member for absorbing a force reflecting the travel distance of a golf ball, a pointer mounted on said housing displaceable by said further member in response to a displacement of said further member, and a scale means provided on said housing and cooperable with the pointer for providing an indication of the travel distance of a golf ball; and means for enabling a determination of the travel path of a driven golf ball including a further pointer pivotably mounted on said guide member and pivoted in response to deviation in the flight path of a golf ball, and a further scale means mounted on said housing and cooperable with said further pointer for providing an indication of the flight path of a golf ball.

2. A golf practice device according to claim 1, wherein a golf ball is connected to the further member by a cord, and wherein said further pointer includes a hollow tube member through which the cord extends.

3. A golf practice device according to claim 2, wherein said further pointer includes a rotatable base member for mounting said pointer on said guide member.

4. A golf practice device according to claim 3, wherein a pair of support means are provided at opposite ends of the guide member for supporting said guide member in said housing.

5. A golf practice device according to claim 4, wherein means are provided on at least one of said support means for cushioning an impact of the further member against said support means.

6. A golf practice device according to claim 5, wherein means are provided for enabling an adjustment of the rotatable base member relative to the guide member.

7. A golf practice device according to claim 6, wherein said scale means for providing an indication of the travel distance is arranged along a longitudinally extending slot provided in said housing, and wherein said pointer cooperable with said last-mentioned scale means is displaceably mounted on an edge of said slot.

8. A golf practice device according to claim 7, further comprising means provided on said flexible base member for enabling a teeing-up of the golf ball.

9. A golf practice device according to claim 8, wherein means are arranged in said cord between said further pointer and the golf ball for preventing a tangling of said cord when said golf ball is driven.

10. A golf practice device according to claim 9, further comprising means provided on said housing for enabling a storage of the cord directly on the housing.

11. A golf practice device according to claim 10, wherein said means for enabling a teeing-up includes a flexible support member mounted in said flexible base member, and a tubular member mounted on said flexible support member for supporting the golf ball.

12. A golf practice device according to claim 11, wherein the golf ball includes an opening extending therethrough for accommodating a means for securing an end of the cord to the golf ball.

13. A golf practice device according to claim 12, wherein means are provided for tethering said tubular member to said flexible base member so as to prevent the tubular member from being displaced beyond a predetermined distance upon a driving of the golf ball.

14. A golf practice device according to claim 1, further comprising means provided on said flexible base member for enabling a teeing-up of a golf ball.

15. A golf practice device according to claim 1, wherein said further pointer includes a rotatable base member for mounting said pointer on said guide member, wherein a pair of support means are provided at opposite ends of the guide member for supporting said guide member in said housing.

16. A golf practice device according to claim 1, wherein said further pointer includes a rotatable base member for mounting said pointer on said guide member, wherein a pair of support means are provided at opposite ends of the guide member for supporting said guide member in said housing, means are provided on at least one of said support means for cushioning an impact of the further member against said support means, means are provided for enabling an adjustment of the rotatable base member relative to the guide member, wherein said scale means for providing an indication of the travel distance is arranged along a longitudinally extending slot provided in said housing, and wherein said pointer cooperable with said last-mentioned scale means is displaceably mounted on an edge of said slot.

17. A golf practice device according, to claim 16, further comprising a cord for connecting a golf ball to the further member, means provided on said flexible base member for enabling a teeing-up of the golf ball, means arranged in said cord between said further pointer and the golf ball for preventing a tangling of said cord when said golf ball is driven.

18. A golf practice device according to claim 17, further comprising means provided on said housing for enabling a storage of the cord directly on the housing.

19. A golf practice device according to claim 18, wherein said means for enabling a teeing-up includes a flexible support member mounted in said flexible base member, and a tubular member mounted on said flexible support member for supporting the golf ball, wherein the golf ball includes an opening extending therethrough for accommodating a means for securing an end of the cord to the golf ball.

* * * * *